US006168553B1

(12) United States Patent
Kuo

(10) Patent No.: US 6,168,553 B1
(45) Date of Patent: Jan. 2, 2001

(54) ADJUSTING MECHANISM FOR A SEAT BACK OF AN EXERCISER

(76) Inventor: Hai Pin Kuo, No. 158, Sec. 1, Er Jen Road, Jen Teh Hsiang, Tainan Hsien 717 (TW)

( * ) Notice: Under 35 U.S.C. 154(b), the term of this patent shall be extended for 0 days.

(21) Appl. No.: 09/285,821

(22) Filed: Apr. 2, 1999

(51) Int. Cl.[7] ..... A63B 22/06

(52) U.S. Cl. ..... 482/57; 482/908; 297/354.1; 297/363; 297/367

(58) Field of Search ..... 482/57, 51, 58, 482/59, 908; 297/353, 354.1, 361.1, 362.11, 362.14, 363, 364, 367

(56) References Cited

U.S. PATENT DOCUMENTS 4,660,886 * 4/1987 Terada et al. ..... 297/367

* cited by examiner

*Primary Examiner*—Jerome W. Donnelly
*Assistant Examiner*—Tam Nguyen
(74) *Attorney, Agent, or Firm*—Charles E. Baxley

(57) ABSTRACT

An adjusting mechanism for an exerciser includes a seat and a frame secured on a base. A seat back is pivotally secured to the base at a pivot axle and includes a sector gear. A handle includes a shaft rotatably secured to the frame and having a pawl that is biased to engage with the sector gear of the seat back and to secure the seat back to the base at the selected angular position. A sleeve is secured on the shaft and the pawl is extended upward from the sleeve and a spring engaged with the sleeve to bias the pawl to engage with the sector gear of the seat back.

6 Claims, 5 Drawing Sheets

ADJUSTING MECHANISM FOR A SEAT BACK OF AN EXERCISER

BACKGROUND OF THE INVENTION

1. Field of the Invention

The present invention relates to an adjusting mechanism, and more particularly to an adjusting mechanism for a seat back of an exerciser.

2. Description of the Prior Art

Typical exercisers, particularly some of the cycling exercisers, comprise a solid seat back that may not be adjusted to different angular positions according to the user's need, such that the users may feel uncomfortable.

The present invention has arisen to mitigate and/or obviate the afore-described disadvantages of the conventional exercisers.

SUMMARY OF THE INVENTION

The primary objective of the present invention is to provide an adjusting mechanism for allowing a seat back of an exerciser to be easily adjusted to different angular positions.

In accordance with one aspect of the invention, there is provided a seat back adjusting mechanism for an exerciser comprising a base including a front portion having a seat provided thereon and including a rear portion having a frame secured thereon, a seat back pivotally secured to the base at a pivot axle, and means for selectively securing the seat back to the base at a selected angular position.

The seat back includes a sector gear provided thereon, the frame includes a shaft rotatably secured therein and having a handle extended therefrom for rotating the shaft, the shaft includes a pawl provided thereon, and means for biasing the pawl of the shaft to engage with the sector gear of the seat back and to secure the seat back to the base at the selected angular position. The pivot axle of the seat back includes two ends, the frame includes two bearings engaged on the ends of the pivot axle, and means for securing the bearings to the frame.

The seat back includes a seat cushion having a rear portion, and includes a beam secured to the rear portion of the seat cushion and having a lower portion, the pivot axle is secured to the lower portion of the beam. One or more springs are engaged between the frame and the seat back for biasing the seat back forward.

A sleeve is secured on the shaft and rotated in concert with the shaft, the pawl is extended upward from the sleeve. The sleeve includes an extension and a spring engaged between the extension of the sleeve and the base for biasing the pawl of the sleeve to engage with the sector gear of the seat back.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
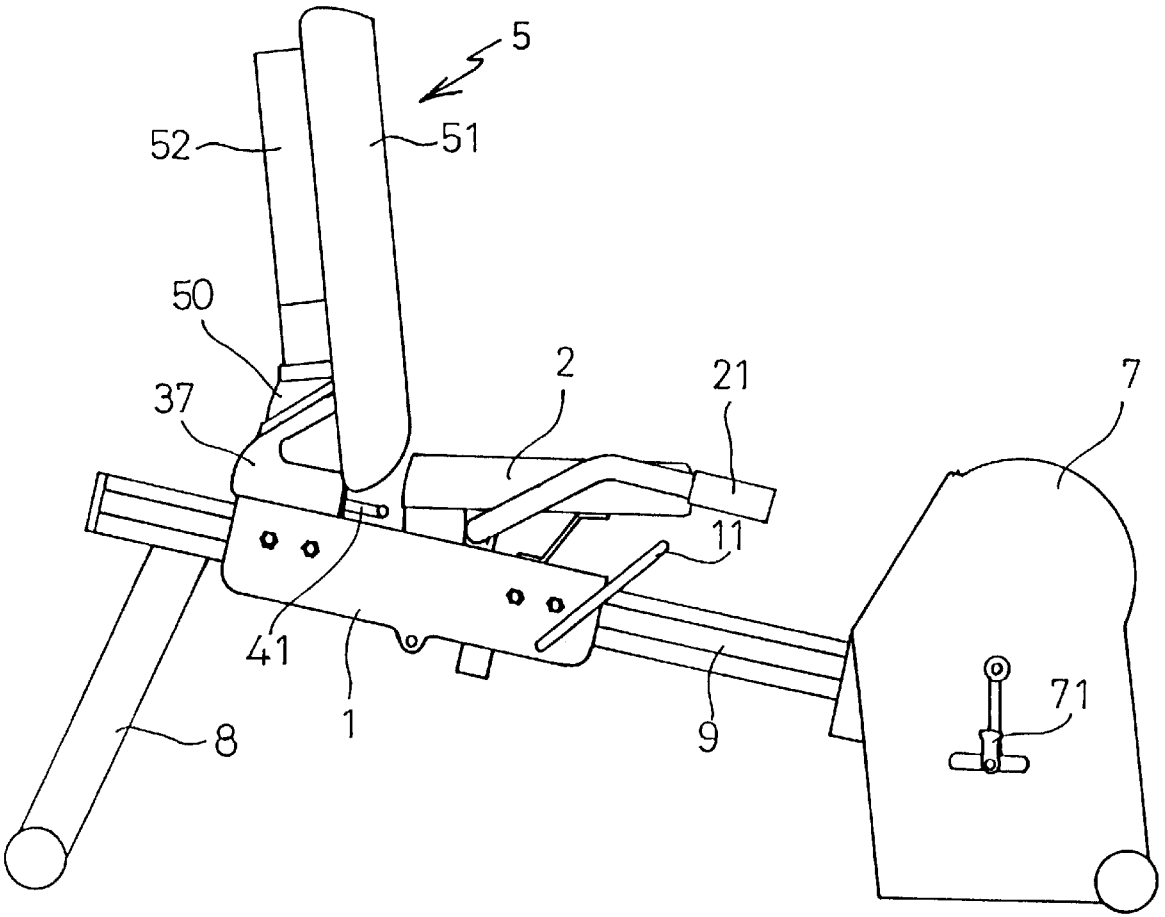
FIG. 1 is a side view of an exerciser in accordance with the present invention.
Figure 2:
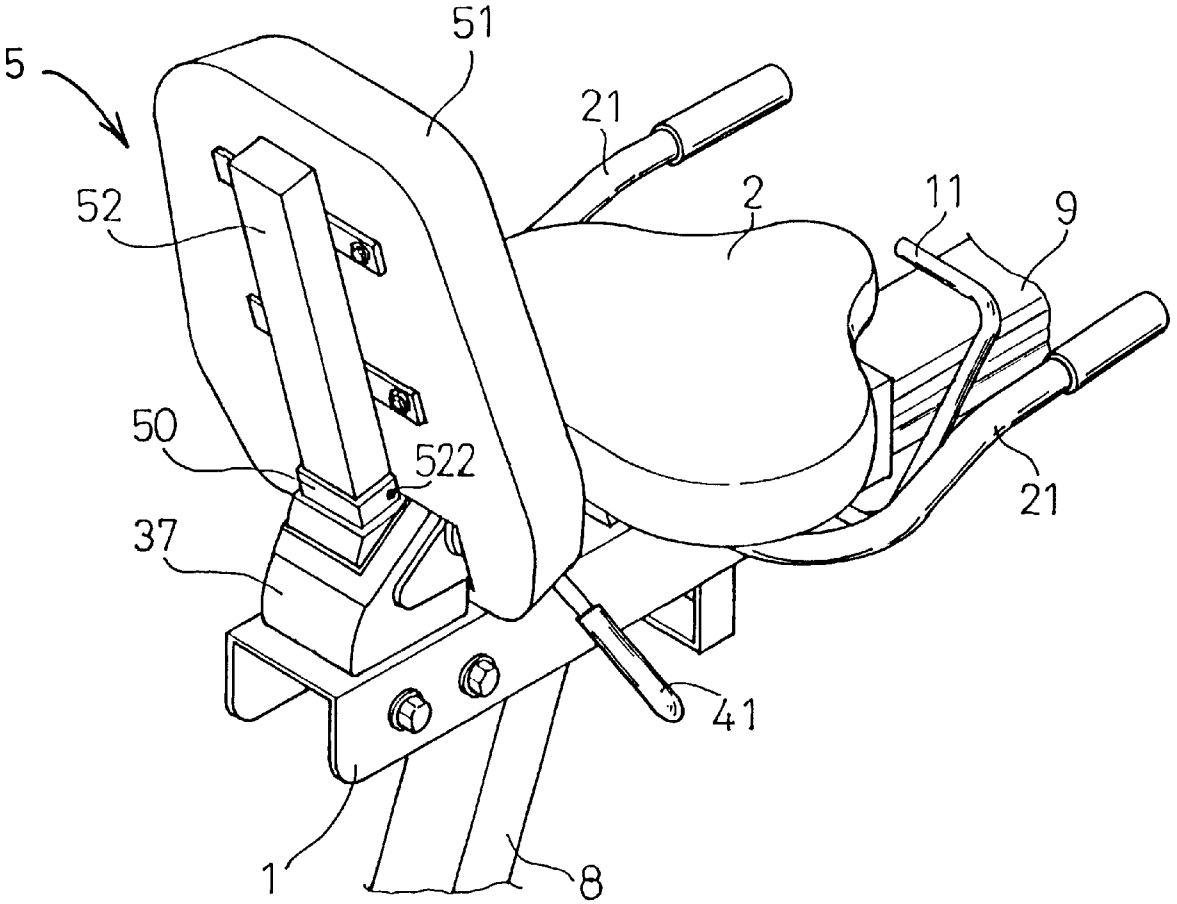
FIG. 2 is a partial rear perspective view of the exerciser.

Referring to the drawings, and initially to FIGS. 1–5, an exerciser in accordance with the present invention comprises an exerciser body 7 including a pair of foot supports 71 provided thereon for cycling purposes and including a track 9 extended rearward therefrom and supported in place by a stay 8. A base 1 is slidably engaged on the track 9 and adjustably and selectively secured to the track 9 by a hand grip 11 via a typical spring-biased latch device which is not related to the present invention and will not be discussed in further details. A seat 2 is secured on the base 1 for supporting the user, and another hand grip 21 is secured on the base 1 for allowing the users to stabilize their bodies.

Figure 3:
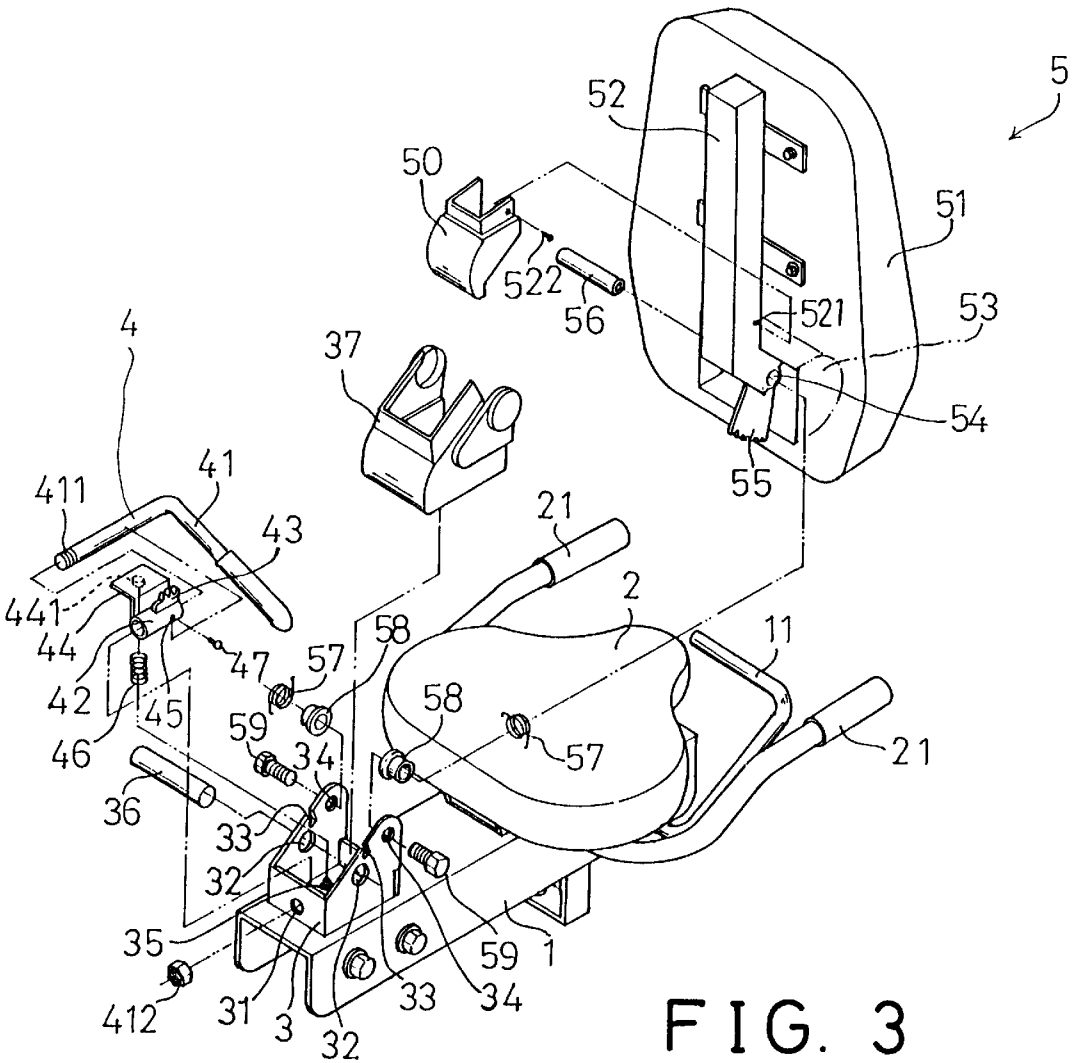
FIG. 3 is an exploded view of the seat back adjusting mechanism.
Figure 4:
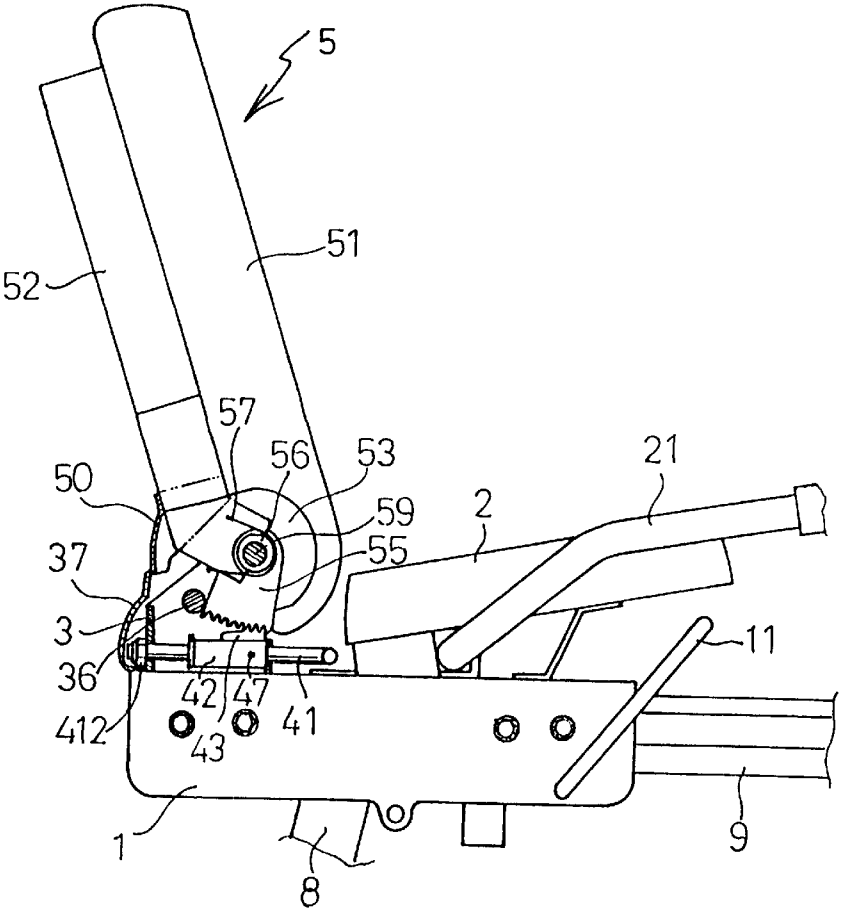
FIG. 4 is a partial side view illustrating the seat back adjusting mechanism.
Figure 5:
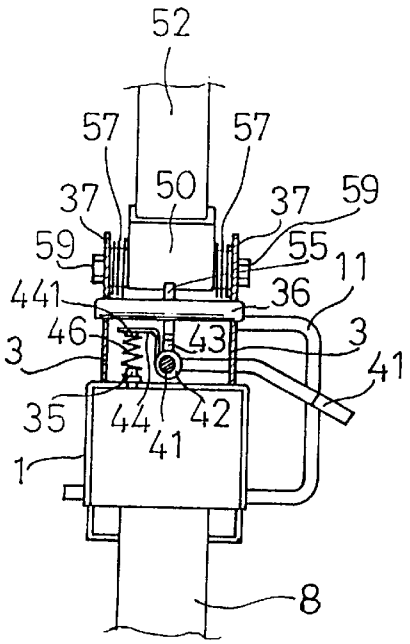
FIGS. 5 and 6 are partial rear views illustrating the operation of the seat back adjusting mechanism.

A frame 3 is secured on the rear portion of the base 1 and includes a pair of holes 31 for rotatably receiving a shaft 4 which includes an outer thread 411 for engaging with a nut 412 for rotatably securing the shaft 4 to the frame 3. The shaft 4 includes a handle 41 extended therefrom for rotating the shaft 4. A sleeve 42 is engaged on the shaft 4 and secured to the shaft 4 by a fastener 47 such that the sleeve 42 rotates in concert with the shaft 4. The sleeve 42 includes a number of teeth or a pawl 43 extended upward therefrom and includes an extension 44 having a bulge 441 extended downward therefrom (FIGS. 3, 5). A spring 46 is engaged between the bulge 441 of the extension 44 and a projection 35 of the base 1 for allowing the spring 46 to be stably retained in place. The spring 46 is arranged to bias the pawl 43 to the upper portion of the sleeve 42 (FIGS. 4, 5) and to bias the handle 41 downward. A stop 36 is laterally engaged in the frame 3 and engaged with the holes 32 of the frame 3, and preferably perpendicular to the shaft 4.

A seat back 5 includes a beam 52 secured to the back portion of a seat cushion 51. The beam 52 includes a screw hole 521 for engaging with a fastener 522 which may secure a cap 50 to the bottom portion of the beam 52. The bottom portion of the beam 52 includes a hole 54 for receiving an axle 56 and includes a sector gear 55 extended downward therefrom for engaging with the pawl 43 of the sleeve 42 (FIGS. 4, 5). The axle 56 has two ends rotatably engaged in two bearings 58 which are secured to the frame 3 by fasteners 59, such that the seat back 5 may be rotated relative to the frame 3 about the axle 56. Two springs 57 are engaged on the bearings 58 and has one end engaged with the notches 33 (FIG. 3) of the frame 3 and has the other end engaged into the beam 52 (FIG. 4) for biasing the seat back 5 forward. The seat cushion 51 includes a recess 53 formed in the lower portion for receiving a portion of the frame 3 and a portion of the axle 56. A cover 37 is secured to the rear portion of the frame 3 for shielding the members in the frame 3.

Figure 7:
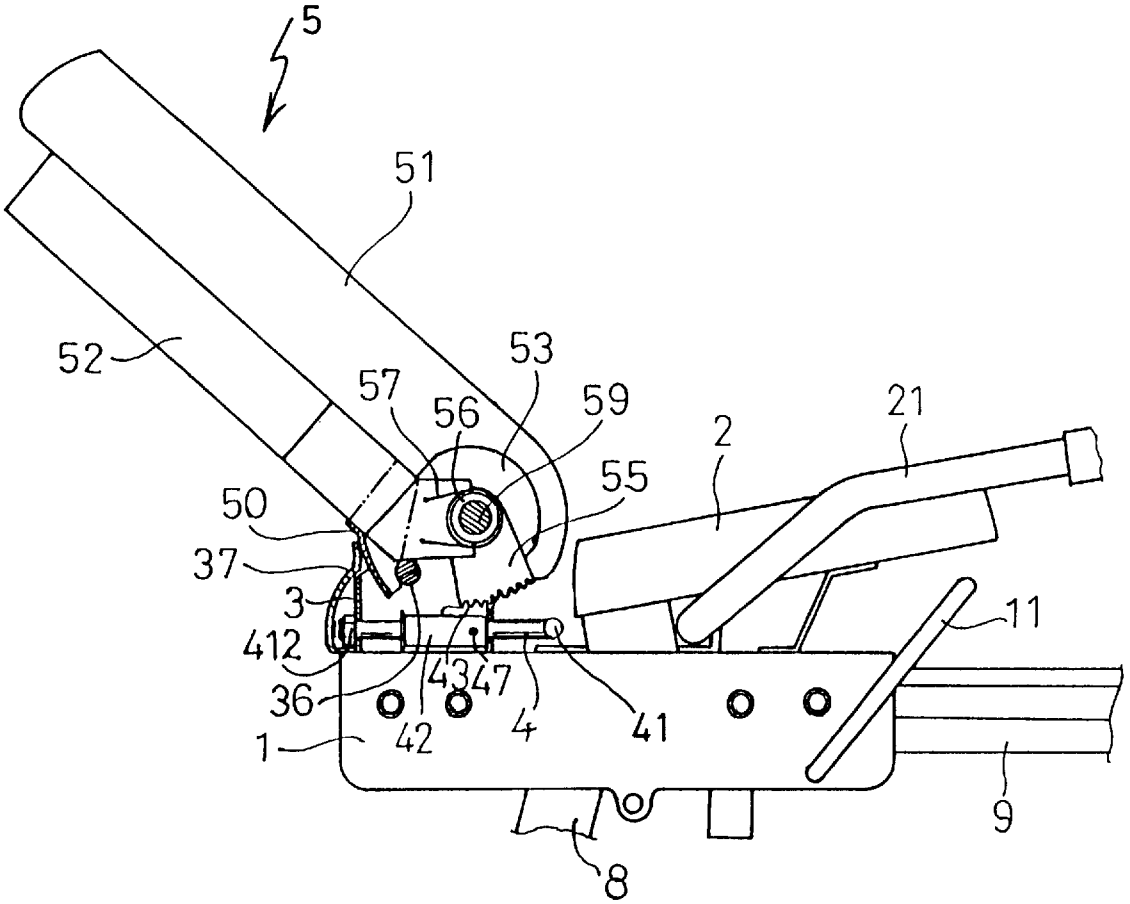
FIG. 7 is a partial side view similar to FIG. 4, illustrating the operation of the seat back adjusting mechanism.
Figure 6:
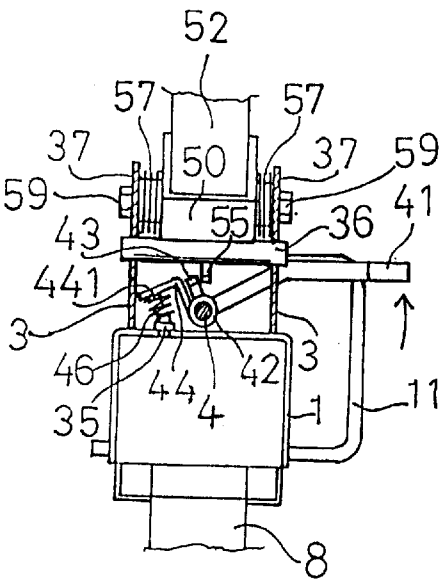

In operation, as shown in FIGS. 4 and 5, the spring 46 may bias the pawl 43 of the sleeve 42 to engage with the sector gear 55 of the beam 52 so as to position the seat back 5 at the required angular position relative to the base 1. As shown in FIG. 6, when the pawl 43 is disengaged from the sector gear 55 of the beam 52 by pulling the handle 41 against the spring 46, the beam 52 of the seat back 5 may thus rotate relative to the base 1 about the axle 56 to the required angular position. When the handle 41 is released, the spring 46 may bias the pawl 43 of the sleeve 42 to engage with the sector gear 55 of the beam 52 again so as to position the seat back 5 at the selected angular position relative to the base 1. As shown in FIGS. 4 and 7, the stop 36 may engage with the sector gear 55 (FIG. 4) or the beam 52 (FIG. 7) so as to limit the rotational movement of the seat back 5 relative to the base 1.

It is to be noted that the pawl 43 may be formed or attached to the beam 52 or directly attached to the seat back 5 for engaging with the internal gear that may be provided on the sleeve 42, such that the seat back 5 may also be easily adjusted to the required angular position relative to the base 1. The pawl 43 may also be directly provided or formed on the shaft 4 without the sleeve 42.

Accordingly, the adjusting mechanism in accordance with the present invention may be provided for allowing a seat back of an exerciser to be easily adjusted to different angular positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A seat back adjusting mechanism for an exerciser, said adjusting mechanism comprising:

a base including a front portion having a seat provided thereon and including a rear portion having a frame secured thereon, said frame including a shaft rotatably secured therein and having a handle extended therefrom for rotating said shaft, said shaft including a pawl provided thereon, a seat back pivotally secured to said base at a pivot axle, said seat back including a sector gear provided thereon, said pivot axle of said seat back including two ends, said frame including two bearings engaged on said ends of said pivot axle, means for securing said bearing to said frame, means for biasing said pawl of said shaft to engage with said sector gear of said seat back and to secure said seat back to said base at the selected angular position, and means for selectively securing said seat back to said base at a selected angular position.

2. The adjusting mechanism according to claim 1, wherein said seat back includes a seat cushion having a rear portion, and includes a beam secured to said rear portion of said seat cushion and having a lower portion, said pivot axle is secured to said lower portion of said beam.

3. The adjusting mechanism according to claim 1 further comprising means for biasing said seat back forward.

4. The adjusting mechanism according to claim 2 further comprising at least one spring engaged between said frame and said beam of said seat back for biasing said seat back forward.

5. A seat back adjusting mechanism for an exerciser, said adjusting mechanism comprising:

a base including a front portion having a seat provided thereon and including a rear portion having a frame secured thereon, said frame including a shaft rotatably secured therein and having a handle extended therefrom for rotating said shaft, said shaft including a pawl provided thereon, a seat back pivotally secured to said base at a pivot axle, said seat back including a sector gear provided thereon, means for selectively securing said seat back to said base at a selected angular position, means for biasing said pawl of said shaft to engage with said sector gear of said seat back and to secure said seat back to said base at the selected angular position, and a sleeve secured on said shaft and rotated in concert with said shaft, said pawl being extended upward from said sleeve.

6. The adjusting mechanism according to claim 5, wherein said sleeve includes an extension extended therefrom, said pawl biasing means includes a spring engaged between said extension of said sleeve and said base for biasing said pawl of said sleeve to engage with said sector gear of said seat back.

* * * * *